US011677167B2

(12) United States Patent
Kousaka et al.

(10) Patent No.: US 11,677,167 B2
(45) Date of Patent: Jun. 13, 2023

(54) ELECTRIC WIRE WITH TERMINAL AND TERMINAL CRIMPING DEVICE

(71) Applicant: Yazaki Corporation, Tokyo (JP)

(72) Inventors: Hiroya Kousaka, Makinohara (JP); Kei Sato, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/454,903

(22) Filed: Nov. 15, 2021

(65) Prior Publication Data

US 2022/0158364 A1 May 19, 2022

(30) Foreign Application Priority Data

Nov. 19, 2020 (JP) ..... JP2020-192422
Mar. 19, 2021 (JP) ..... JP2021-045735

(51) Int. Cl.
*H01R 4/18* (2006.01)
*H01R 43/048* (2006.01)

(52) U.S. Cl.
CPC ..... *H01R 4/185* (2013.01); *H01R 43/048* (2013.01); *H01R 2201/26* (2013.01)

(58) Field of Classification Search
CPC ... H01R 4/185; H01R 43/048; H01R 2201/26
USPC ..... 439/877
See application file for complete search history.

(56) References Cited

U.S. PATENT DOCUMENTS

| | | | | |
|---|---|---|---|---|
| 9,287,655 | B2 * | 3/2016 | Sato | H01R 43/005 |
| 10,003,136 | B2 * | 6/2018 | Ohnuma | H01R 4/18 |
| 10,069,217 | B2 * | 9/2018 | Hamada | H01R 4/188 |
| 10,340,610 | B2 * | 7/2019 | Hamada | H01R 4/185 |
| 2016/0254603 | A1 * | 9/2016 | Terasaka | H01R 43/05 439/877 |
| 2017/0317430 | A1 * | 11/2017 | Kawamura | H01R 4/185 |
| 2018/0109010 | A1 * | 4/2018 | Takahashi | H01R 13/04 |

FOREIGN PATENT DOCUMENTS

| | | | | |
|---|---|---|---|---|
| JP | 2009-245701 | A | 10/2009 | |
| JP | 2015125978 | A * | 7/2015 | |
| JP | 2015185465 | A * | 10/2015 | |
| JP | 2016164841 | A * | 9/2016 | H01R 4/185 |
| JP | 2019-185904 | A | 10/2019 | |
| WO | WO-2014129600 | A1 * | 8/2014 | H01B 7/2806 |

(Continued)

*Primary Examiner* — Peter G Leigh
(74) *Attorney, Agent, or Firm* — Sughrue Mion, PLLC

(57) ABSTRACT

An electric wire with terminal includes an electric wire including a core wire and a cover covering the core wire, and a terminal to be attached to the electric wire. The terminal includes a placement portion onto which the electric wire is placed, a pair of core wire crimp pieces extending from the placement portion and configured to be crimped to the core wire, and a pair of cover crimp pieces extending from the placement portion and configured to be crimped to the cover. In a state where the pair of cover crimp pieces is crimped to the cover, the pair of cover crimp pieces includes a recessed portion positioned at an intermediate position in an electric wire extending direction in which the electric wire extends, and a pair of inclined portions continuous with both ends of the recessed portion and inclined radially outward.

6 Claims, 13 Drawing Sheets

(56) References Cited

FOREIGN PATENT DOCUMENTS

| | | | | |
|---|---|---|---|---|
| WO | WO-2015146819 | A1 * | 10/2015 | ..... B60R 16/0215 |
| WO | WO-2016031795 | A1 * | 3/2016 | ..... H01R 4/18 |
| WO | WO-2016031798 | A1 * | 3/2016 | ..... B60K 37/06 |
| WO | WO-2016167125 | A1 * | 10/2016 | ..... H01R 4/185 |
| WO | WO-2016186021 | A1 * | 11/2016 | |

* cited by examiner

ELECTRIC WIRE WITH TERMINAL AND TERMINAL CRIMPING DEVICE

TECHNICAL FIELD

The present invention relates to an electric wire with terminal and to a terminal crimping device.

BACKGROUND

Automobiles are equipped with a wide variety of electronic devices, and wire harnesses are wired thereto to transmit power and control signals and such to the electronic devices. Such wire harness includes an electric wire, a terminal fitting connected to an end of the electric wire, and a connector housing that houses the terminal fitting. Herein, the electric wire including the terminal fitting connected to the end of the electric wire is referred to as "electric wire with terminal".

As the terminal fitting that constitutes the electric wire with terminal, a crimp terminal may be used that is configured to be crimped and connected to a conductor portion where a cover of an electric wire is removed (refer to Patent Document 1).

A crimp terminal disclosed in Patent Document 1 includes a tube-shaped electrical contact portion to which a mating terminal is inserted and connected, a front barrel portion configured to be crimp connected to a core wire of an electric wire, and a rear barrel portion configured to be crimp connected to a cover of the electric wire. The front barrel portion includes a barrel bottom portion onto which the core wire of the electric wire is placed, and a pair of front barrel pieces extending from the barrel bottom portion and configured to be crimped to the core wire of the electric wire. The front barrel pieces are partially cutout at tips thereof and on a side of the rear barrel portion. Since the front barrel pieces are partially cutout, when the front barrel pieces are crimped to the core wire of the electric wire, an amount of compression of the core wire of the electric wire can be reduced and thus a compression load on the core wire can be reduced, thereby reducing a risk of breakage with respect to pulling.

PRIOR ART DOCUMENT

Patent Document 1: JP 2009-245701 A

SUMMARY OF THE INVENTION

Problem to be Solved by the Invention

However, in the conventional electric wire with terminal, during the crimping of the crimp terminal of the electric wire, the pair of rear barrel pieces is pressed by a terminal crimping jig and each rear barrel piece is bent relative to the cover of the electric wire and crimped to the cover of the electric wire. At this time, corners of the respective rear barrel pieces may cut into the cover of the electric wire and cause breakage of the cover.

In view of the above, an object of the present invention is to provide an electric wire with terminal capable of preventing breakage a cover, and a terminal crimping device.

Solution to the Problem

In order to achieve the above-described object, the present invention provides a first electric wire with terminal that includes an electric wire including a core wire and a cover covering the core wire, and a terminal to be attached to the electric wire, wherein the terminal includes a placement portion onto which the electric wire is placed, a pair of core wire crimp pieces extending from the placement portion and configured to be crimped to the core wire, and a pair of cover crimp pieces extending from the placement portion and configured to be crimped to the cover, and wherein, in a state where the pair of cover crimp pieces is crimped to the cover, the pair of cover crimp pieces includes a recessed portion positioned at an intermediate position in an electric wire extending direction in which the electric wire extends, and a pair of inclined portions continuous with both ends of the recessed portion and inclined radially outward.

Further, in order to achieve the above-described object, the present invention provides a second electric wire with terminal that includes an electric wire including a core wire and a cover covering the core wire, and a terminal to be attached to the electric wire, wherein the terminal includes a placement portion onto which the electric wire is placed, a pair of core wire crimp pieces extending from the placement portion and configured to be crimped to the core wire, and a pair of cover crimp pieces extending from the placement portion and configured to be crimped to the cover, and wherein, in a state where the pair of cover crimp pieces is crimped to the cover, the pair of cover crimp pieces includes a recessed portion, and an inclined portion that is continuous with a front side of the recessed portion located on a side of the pair of core wire crimp pieces and that is inclined radially outward.

In another aspect, a terminal crimping device for producing the first electric wire with terminal and the second electric wire with terminal includes a die configured to put respective tips of the pair of cover crimp pieces close to each other to crimp the cover in a state where the cover is placed onto the placement portion, wherein the die includes a recess forming portion for forming the recessed portion, and a dimension in the electric wire extending direction of the recess forming portion is smaller than a dimension in the electric wire extending direction of the pair of cover crimp pieces before crimping.

Advantageous Effect of the Invention

According to the first electric wire with terminal and the second electric wire with terminal, and according to the terminal crimping device for producing the first electric wire with terminal and the second electric wire with terminal, the pair of cover crimp pieces is crimped such that the recessed portion and the inclined portion that is continuous with the recessed portion and that is inclined radially outward are formed in the state where the pair of cover crimp pieces is crimped to the cover, which can prevent the breakage of the cover caused by the corners of the rear barrel cutting into the cover during the crimping as in the case with the conventional art.

DETAILED DESCRIPTION OF THE EXEMPLARY EMBODIMENTS

First Embodiment

Figure 1:
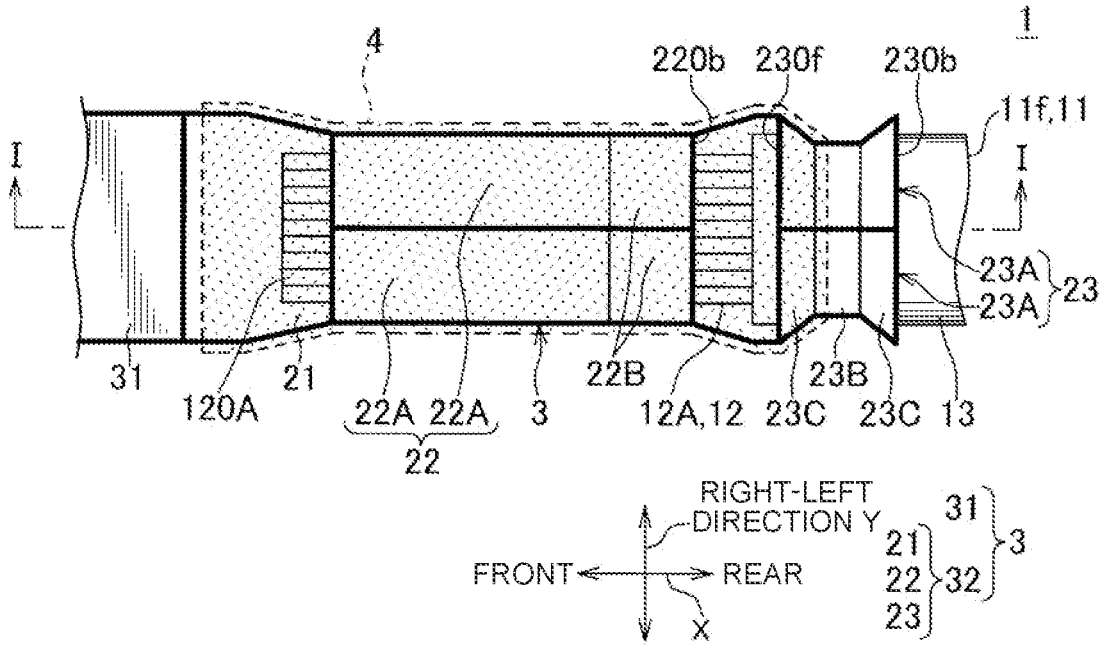
FIG. 1 is a plan view of an electric wire with terminal according to a first embodiment of the present invention.
Figure 2:
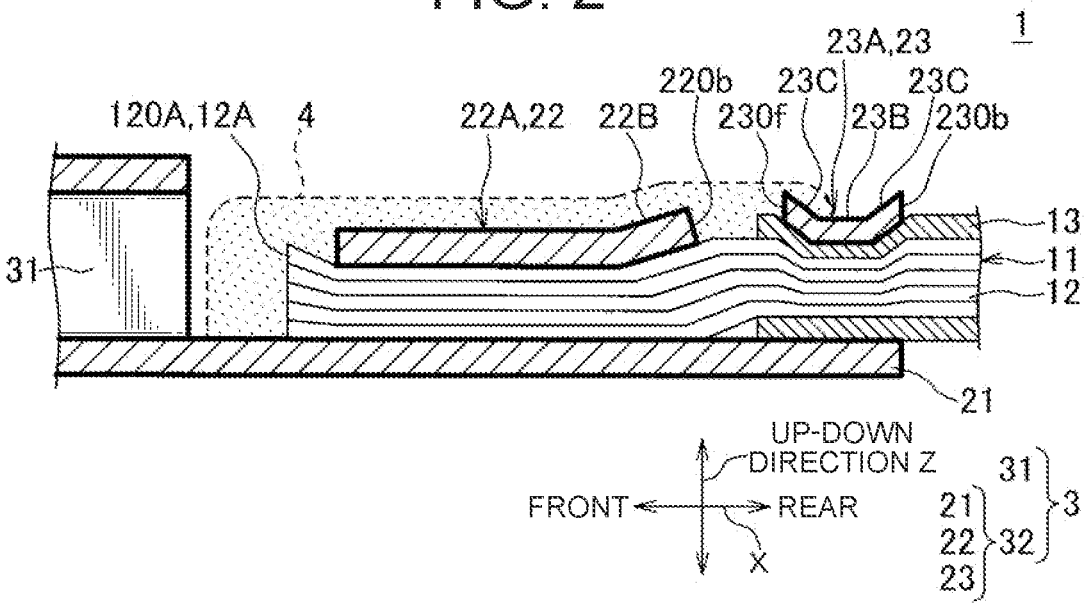
FIG. 2 is a cross-sectional view taken along a line I-I in FIG. 1.
Figure 3:
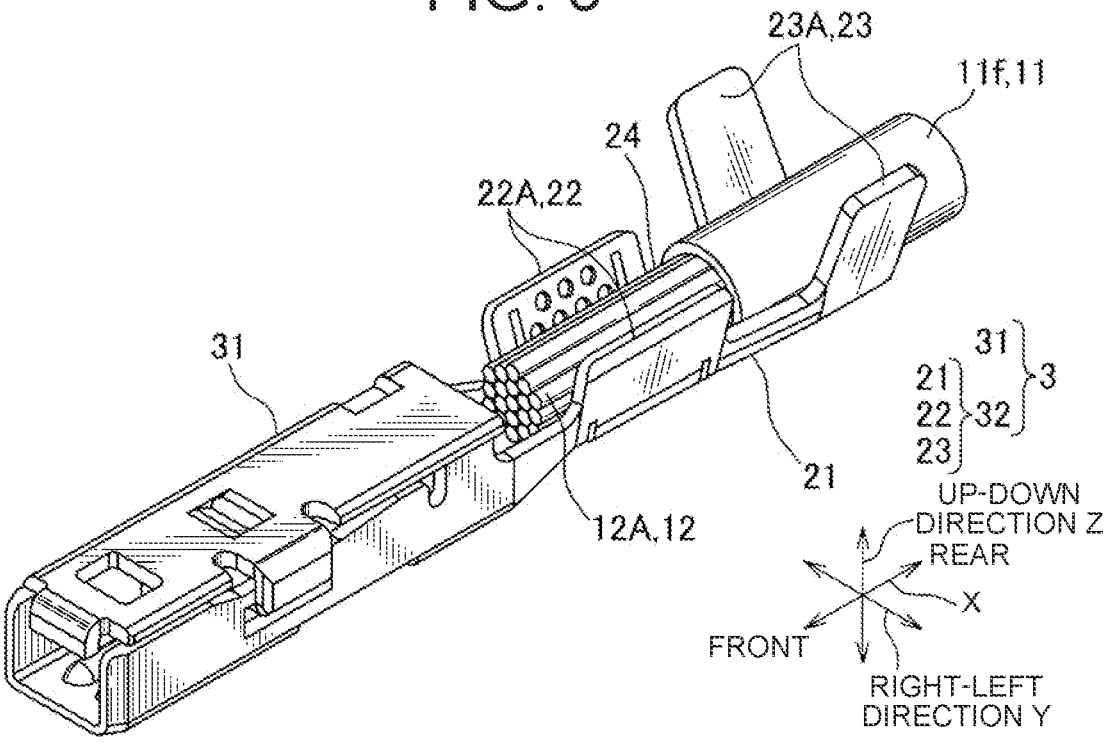
FIG. 3 is a perspective view illustrating production of the electric wire with terminal and showing a state where an electric wire is placed on a terminal.

In the following, a first embodiment of the present invention will be described with reference to FIG. 1 to FIG. 4B. FIG. 1 is a plan view of an electric wire with terminal 1 according to one embodiment of the present invention. FIG. 2 is a cross-sectional view of the electric wire with terminal 1 taken along a line I-I. FIG. 3 is a perspective view illustrating production of the electric wire with terminal 1 and showing a state where an electric wire 11 is placed on an appropriate position on a terminal 3. The electric wire with terminal 1 of this embodiment constitutes a wire harness that is wired on an automobile or the like.

As shown in FIG. 1 and FIG. 2, the electric wire with terminal 1 includes the covered electric wire 11 (hereinafter referred to as the electric wire 11), the terminal 3 connected to each end of the electric wire 11, a sealing portion 4 (anticorrosion portion) covering a portion where a core wire 12 is exposed (hereinafter referred to as the core wire exposed portion 12A) in a state where a pair of core wire crimp pieces 22A, 22A of the terminal 3 is crimped to the core wire 12 of the electric wire 11. In this embodiment, a direction in which the electric wire 11 and the terminal 3 are aligned (hereinafter referred to as the electric wire extending direction or the front-rear direction) is indicated by an arrow X, and a direction (up-down direction) orthogonal (intersecting) to the arrow X is indicated by an arrow Z, and a direction (right-left direction) orthogonal to both directions of the arrow X and the arrow Z is indicated by an arrow Y. Further, in the front-rear direction X, the terminal 3 side may be referred to as "front" direction or frontward, and the electric wire 11 side on the opposite direction may be referred to as "rear" direction or rearward.

As shown in FIG. 2, the electric wire 11 includes a core wire 12 which is an assembly of wire-shaped strands having electrical conductivity, and a cover 13 covering the core wire 12 in an insulating manner. The electric wire 11 is provided such that its axis is arranged along the front-rear direction X. The strand includes aluminum. In other words, the electric wire 11 is an aluminum wire or an aluminum alloy wire. As shown in FIG. 3, at an end 11*f* of the electric wire 11 on the front side, the cover 13 is removed and the core wire 12 is exposed. In this embodiment, the core wire 12 is constituted of an assembly of the wire-shaped strands having electric conductivity, i.e., it is constituted of stranded wires; however, in the present invention, the core wire may be a single wire.

The terminal 3 is constituted of copper or copper alloy. As shown in FIG. 1 to FIG. 3, the terminal 3 includes a mating connection portion 31 configured to be connected to a mating terminal (not shown), and a wire connection portion 32 that is continuous with the mating connection portion 31 and that is connected to the end of the electric wire 11.

As shown in FIG. 3, the wire connection portion 32 includes a placement portion 21 onto which the end of the electric wire 11 is placed, a core wire connection portion 22 that is continuous with the placement portion 21 and that is electrically connected to the exposed core wire 12, and a cover connection portion 23 that is continuous with the placement portion 21 and that is mechanically connected to the cover 13 of the electric wire 11. The cover connection portion 23 is provided at a position spaced a predetermined dimension rearward from the core wire connection portion 22. In the following, this spaced portion between the cover connection portion 23 and the core wire connection portion 22 may be referred to as "intermediate portion 24 (shown in FIG. 3)".

As shown in FIG. 3, the core wire connection portion 22 is positioned between the mating connection portion 31 and the intermediate portion 24. The core wire connection portion 22 extends from the placement portion 21 and includes the pair of core wire crimp pieces 22A, 22A that is crimped to the exposed core wire 12. The cover connection portion 23 extends from the placement portion 21 and includes a pair of cover crimp pieces 23A, 23A that is crimped to the cover 13 of the electric wire 11.

As shown in FIG. 1 and FIG. 2, in a state where the pair of core wire crimp pieces 22A, 22A is crimped to the core wire 12, tips of the pair of core wire crimp pieces 22A, 22A are in contact with each other, and the pair of core wire crimp pieces 22A, 22A is bent at a predetermined position in the front-rear direction X such that rear edges 220*b* thereof extend upward. That is, a core wire inclined portion 22B inclined radially outward is formed on the pair of core wire crimp pieces 22A, 22A in the state where they are crimped to the core wire 12. By forming this core wire inclined portion 22B, the rear edges 220*b* of the pair of core wire crimp pieces 22A, 22A are prevented from biting into the core wire 12 during the crimping.

As shown in FIG. 1 and FIG. 2, in the state where the pair of cover crimp pieces 23A, 23A is crimped to the cover 13 of the electric wire 11, tips of the pair of cover crimp pieces 23A, 23A are in contact with each other, and the cover crimp pieces 23A, 23A are bent at two predetermined positions such that a front edge 230*f* and a rear edge 230*b* thereof extend upward, respectively. That is, in the state where the pair of cover crimp pieces 23A, 23A is crimped to the cover 13 of the electric wire 11, there is formed a recessed portion 23B at an intermediate position in the front-rear direction X, and there is also formed a pair of cover inclined portions 23C, 23C (pair of inclined portions) that is continuous with both sides of the recessed portion 23B in the front-rear direction X and that is inclined radially outward. Faces of the recessed portion 23B and of the pair of cover inclined portions 23C, 23C are entirely in contact with the cover 13. The formation of the pair of cover inclined portions 23C, 23C can prevent the front and rear edges 230*f* and 230*b* of the pair of cover crimp pieces 23A, 23A from biting into the cover 13 during the crimping.

Figure 4A:
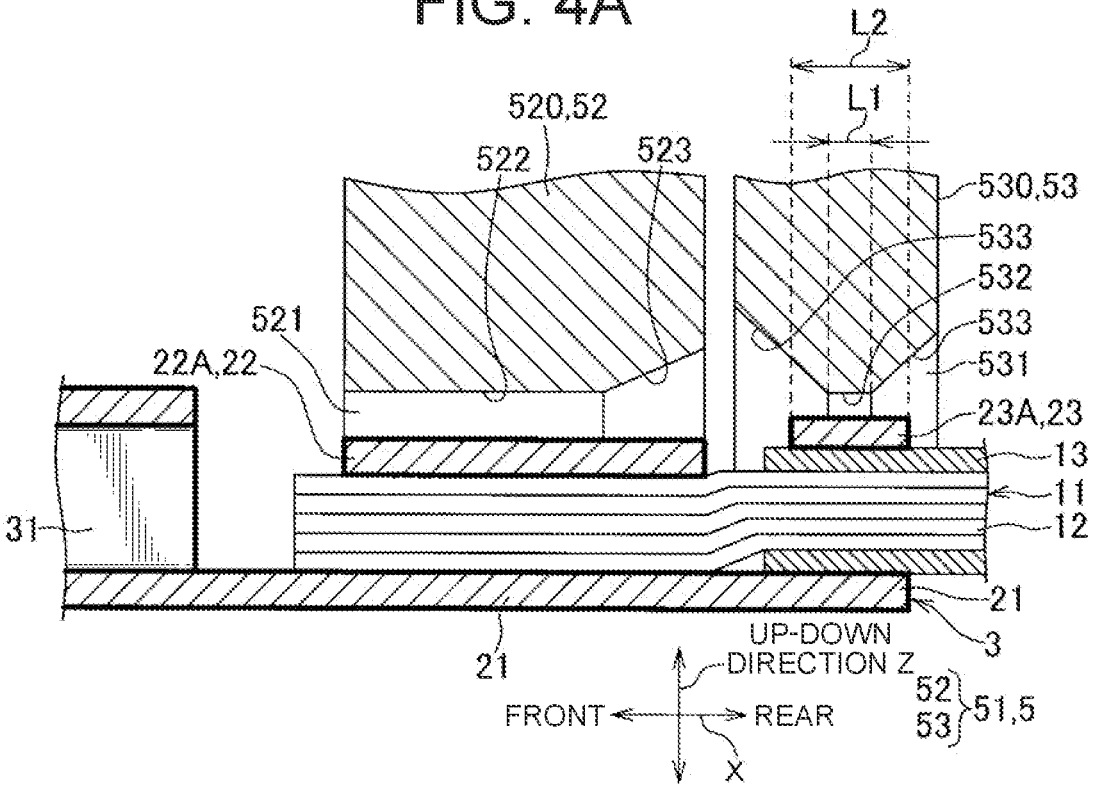
FIG. 4A and FIG. 4B are cross-sectional views illustrating production of the electric wire with terminal using a terminal crimping device, FIG. 4A showing a state before the terminal is crimped to the electric wire, FIG. 4B showing a state where the terminal is crimped to the electric wire.
Figure 4B:
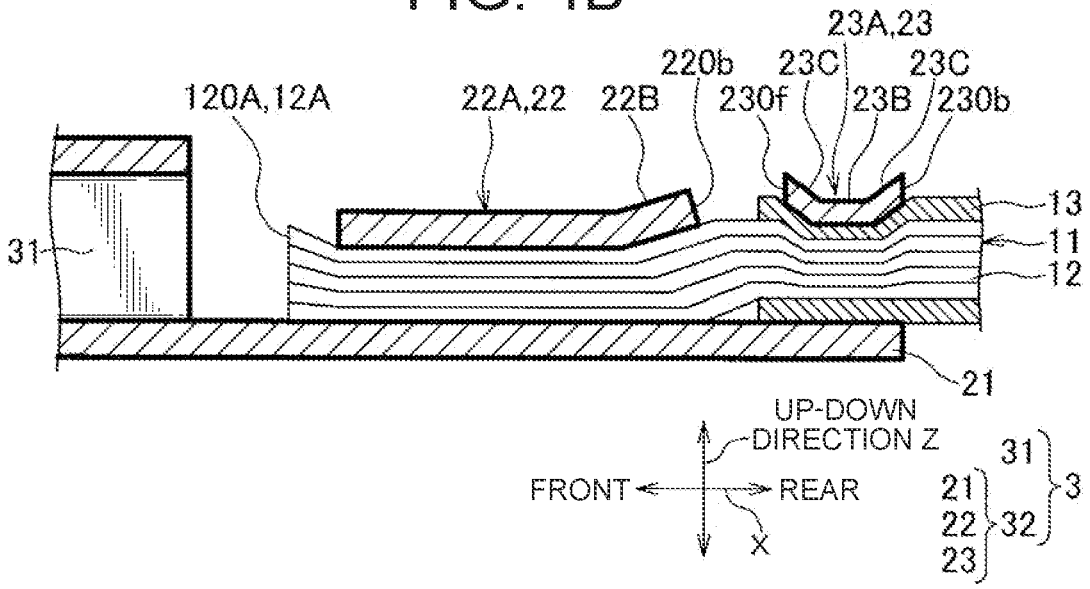

Next, a terminal crimping device 5 used to connect the terminal 3 to the end of the electric wire 11 will be described with reference to FIG. 4A and FIG. 4B. FIG. 4A and FIG. 4B are cross-sectional views illustrating production of the electric wire with terminal 1 using the terminal crimping device 5. The terminal crimping device 5 includes an anvil (not shown) and a crimper 51.

The anvil includes a support board (not shown) that supports the terminal 3 from below. The placement portion 21 of the electric wire connection portion 32 of the terminal 3 is placed on and supported by the support board.

The crimper 51 includes a conductor crimper 52 for crimping the core wire connection portion 22 of the terminal 3, and a cover crimper 53 for crimping the cover connection portion 23. The conductor crimper 52 and the cover crimper 53 are arranged such that the conductor crimper 52 in positioned on the front and the cover crimper 53 is positioned on the rear of the conductor crimper 52, in accordance with the positions of the core wire connection portion 22 and the cover connection portion 123 of the terminal 3 on the support board.

The conductor crimper 52 is provided with a recessed die for conductor 520 configured to receive the pair of core wire crimp pieces 22A, 22A of the terminal 3 placed on the support board. Further, the cover crimper 53 (die) is provided with a recessed die for cover 530 configured to receive the pair of cover crimp pieces 23A, 23A of the terminal 3.

The recessed die for conductor 520 includes a pair of arcuate portions for conductor 521, 521 configured to crimp the pair of core wire crimp pieces 22A, 22A. The arcuate portion for conductor 521 includes an arc-shaped curved face body for conductor 522, and a diameter-enlarged face for conductor 523 continuous with the rear side of the curved face body for conductor 522. The curved face body for conductor 522 is formed such that the cross-section thereof in the right-left direction Y has the same shape at any position. The diameter-enlarged face for conductor 523 is constituted of a curved face having a diameter that increases toward the rear side.

The recessed die for cover 530 includes a pair of arcuate portions for cover 531, 531 configured to crimp the cover crimp pieces 23A, 23A. Each arcuate portion for cover 531 includes an arc-shaped curved face body for cover 532 (recess forming portion), and a pair of diameter-enlarged faces for cover 533, 533 (increased-diameter portions) continuous with both front and rear ends of the curved face body for cover 532. The curved face body for cover 532 is formed such that the cross-section thereof in the right-left direction Y in FIG. 4A has the same shape at any position. As shown in FIG. 4A, a front-rear dimension L1 of the curved face body for cover 532 (i.e., a dimension in the electric wire extending direction of the recess forming portion) is formed so as to be smaller than a front-rear dimension L2 of the pair of cover crimp pieces 23A, 23A before the crimping (i.e., a dimension in the electric wire extending direction of the pair of cover crimp pieces before the crimping) (i.e., L2>L1). Each diameter-enlarged face for cover 533 is constituted of a curved face having a diameter that increases with distance from the curved face body for cover 532 in the front-rear direction X.

When connecting the terminal 3 as described above to the end of the electric wire 11, the core wire 12 is exposed in advance by removing the cover 13 at the end of the electric wire 11. Next, as shown in FIG. 4A, after the terminal 3 and the end of the electric wire 11 are placed on the support board, the conductor crimper 52 and the cover crimper 53 are together moved downward in the Z direction (crimping direction) toward the terminal 3 and the end of the electric wire 11. Due to this downward movement, the pair of cover crimp pieces 23A, 23A is received in each recessed die for cover 530 of the cover crimper 53, and the pair of core wire crimp pieces 22A, 22A is received in each recessed die for conductor 520 of the conductor crimper 52, as shown in FIG. 4B. After the receiving is done, the conductor crimper 52 and the cover crimper 53 continuously apply a certain pressing force in the crimping direction, thereby crimping the pair of core wire crimp pieces 22A, 22A and the pair of cover crimp pieces 23A, 23A, respectively.

Thus, as shown in FIG. 4B, the core wire connection portion 22 is electrically connected to the end of the electric wire 11 and the cover connection portion 23 is mechanically connected to the end of the electric wire 11, thereby connecting the terminal 3 to the end of the electric wire 11.

As shown in FIG. 1 and FIG. 2, the sealing portion 4 is formed such that, in a state where the exposed core wire 12 is placed on the placement portion 21 and crimped by the pair of core wire crimp pieces 22A, 22A, molten UV-curable resin is applied so as to cover the crimped portion and the core wire exposed portion 12A and cured, and, the sealing portion 4 is configured to prevent corrosion of the core wire exposed portion 12A. In this embodiment, the sealing portion 4 is formed such that, in a state where the core wire 12 is placed on the placement portion 21 and crimped by the pair of core wire crimp pieces 22A, 22A, molten UV-curable resin is applied so as to cover a part of the terminal 3 corresponding to the intermediate portion 24, the core wire connection portion 22 and a portion 120A (shown in FIG. 1 and FIG. 2) of the core wire 12 protruding to the tip side from the core wire connection portion 22, and cured, and the sealing portion 4 prevents corrosion of the core wire exposed portion 12A.

Next, a procedure for producing the electric wire with terminal 1 having the above-described configuration is described. First, the core wire 12 is exposed in advance by removing the cover 13 at the end of the electric wire 11. Then, as shown in FIG. 4A, the end of the electric wire 11 is placed on the placement portion 21 of the terminal 3, and the pair of core wire crimp pieces 22A, 22A is crimped to the exposed core wire 12 of the electric wire 11, and the pair of cover crimp pieces 23A, 23A is crimped to the cover 13 of the electric wire 11. Thus, as shown in FIG. 4B, the core wire connection portion 22 is electrically connected to the end of the electric wire 11, and the cover connection portion 23 is mechanically connected to the end of the electric wire 11, thereby connecting the terminal 3 to the end of the electric wire 11. Subsequently, the sealing portion 4 is formed so as to cover the core wire exposed portion 12A and the crimped portion. In this manner, the electric wire with terminal 1 is produced.

According to the embodiment described above, in the state where the pair of cover crimp pieces 23A, 23A is crimped to the cover 13, the pair of cover crimp pieces 23A, 23A includes the recessed portions 23B positioned at the intermediate portion in the front-rear direction X (the electric wire extending direction), and the pair of cover inclined portions 23C, 23C (the inclined portions) that is continuous with the both ends of the recessed portions 23B and that is inclined radially outward, and, the recessed portions 23B are crimped such that the recessed portions 23B are positioned lower than the pair of cover inclined portions 23C, 23C, thereby preventing the respective edges 230*f*, 230*b* of the cover crimp pieces 23A from cutting into the cover 13 and causing the breakage of the cover.

Further, in the state where the pair of cover crimp pieces 23A, 23A is crimped to the cover 13, the faces of the pair of cover crimp pieces 23A, 23A are entirely in contact with the cover 13. Consequently, since the pair of cover crimp pieces 23A, 23A and the cover 13 are in close contact with each other without a gap, it is possible to prevent water from entering between the cover 13 and the pair of cover crimp pieces 23A, 23A.

Further, in the state where the pair of core wire crimp pieces 22A, 22A is crimped to the core wire 12, there is provided the sealing portion 4 (the anticorrosion portion) that covers the core wire exposed portion 12A (the portion where the core wire is exposed). Consequently, corrosion of the core wire exposed portion 12A is prevented.

Further, the terminal crimping device 5 includes the cover crimper 53 (die) that, in the state where the cover 13 is placed on the placement portion 21, puts the respective tips of the pair of cover crimp pieces 23A, 23A close to each other to crimp the pair of cover crimp pieces 23A, 23A to the cover 13, and the cover crimper 53 includes the curved face body for cover 532 (the recess forming portion) for forming the recessed portions 23B, and the dimension L1 in the front-rear direction X (the electric wire extending direction) of the curved face body for cover 532 is formed to be smaller than the dimension L2 in the front-rear direction X of the pair of cover crimp pieces 23A, 23A before the crimping. This can attain a configuration in which the recessed portion 23B is formed by the curved face body for cover 532 in the state where the pair of cover crimp pieces 23A, 23A is crimped to the cover 13.

Further, the diameter-enlarged face for cover 533 (diameter-enlarged portion) having a diameter that increases with distance from the electric wire 11 toward the front-rear direction X (the electric wire extending direction) is provided at a position continuous with the curved face body for cover 532 (recess forming portion) in the front-rear direction X. Consequently, when the pair of cover crimp pieces 23A, 23A is crimped, the pair of cover inclined portions 23C, 23C (inclined portions) is formed by the diameter-enlarged face for cover 533.

The present invention is not limited to the above-described embodiment and includes other configurations and the like which can achieve the object of the present invention, and modifications and the like as described below are also included in the present invention.

In the above-described embodiment, the cover crimper 53 (die) includes the arc-shaped curved face body for cover 532 (recess forming portion), the pair of diameter-enlarged faces for cover 533, 533 (diameter-enlarged portions) that is continuous with both front and rear ends of the curved face body for cover 532; however, the present invention is not limited thereto. The cover crimper 53 (die) may be configured to include only the arc-shaped curved face body for cover 532 (recess forming portion). That is, in the cover crimper 53, the pair of diameter-enlarged faces for cover 533, 533 (diameter-enlarged portions) may be omitted. Even in the case where the pair of diameter-enlarged faces for cover 533, 533 is omitted, the pressing force applied only by the curved face body for cover 532 (recess forming portion) can form the recessed portion 23B and the pair of cover inclined portions 23C, 23C (inclined portions) continuous with both sides of the recessed portion 23B, as long as the dimension L1 in the front-rear direction X of the curved face body for cover 532 is formed so as to be smaller than the dimension L2 in the front-rear direction X of the pair of cover crimp pieces 23A, 23A before the crimping.

Second Embodiment

Figure 5:
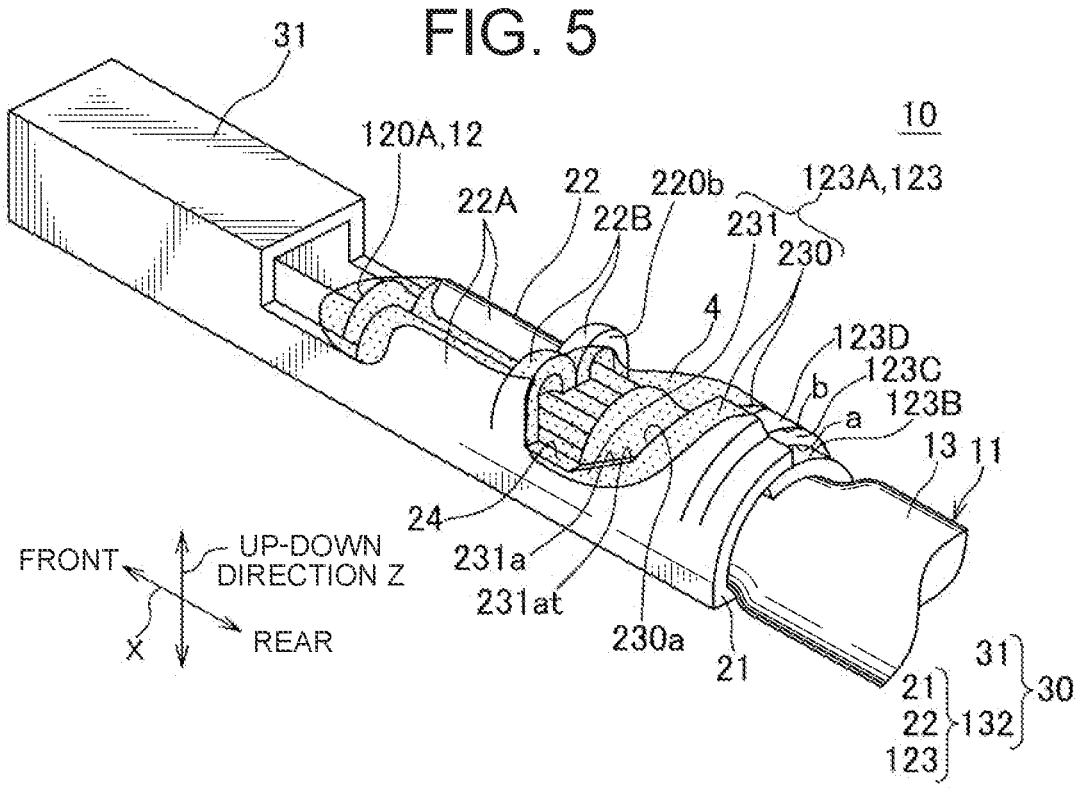
FIG. 5 is a perspective view of an electric wire with terminal according to a second embodiment of the present invention.
Figure 6:
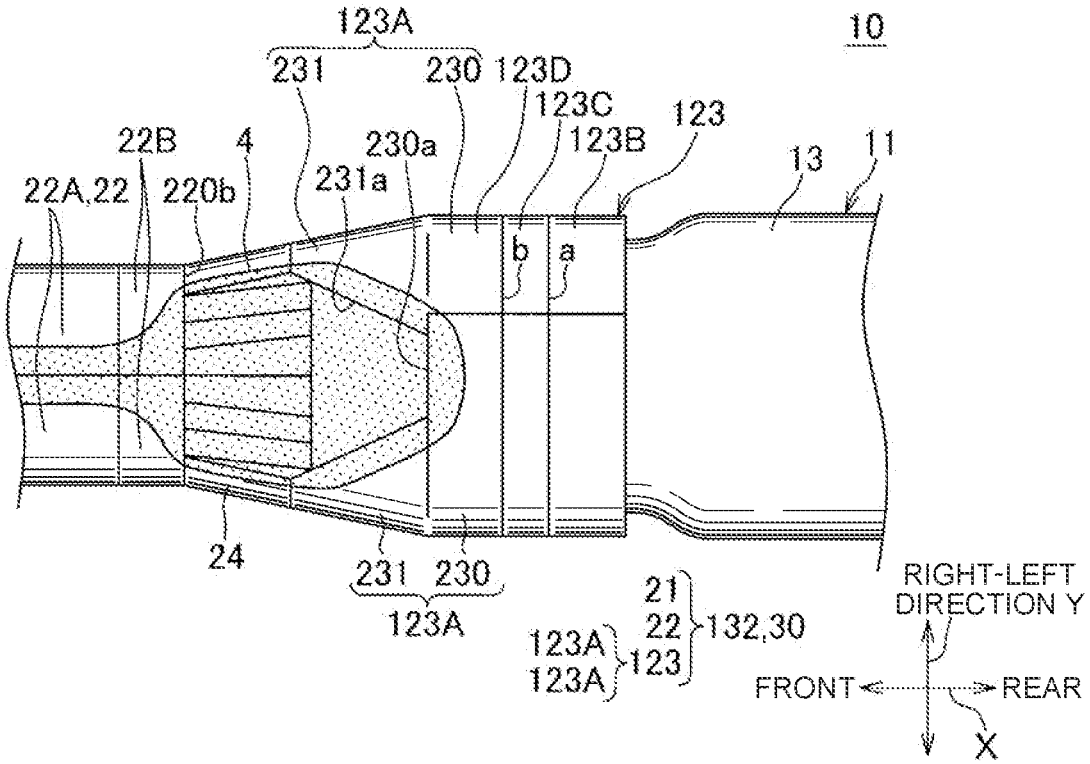
FIG. 6 is a plan view of the electric wire with terminal.
Figure 7:
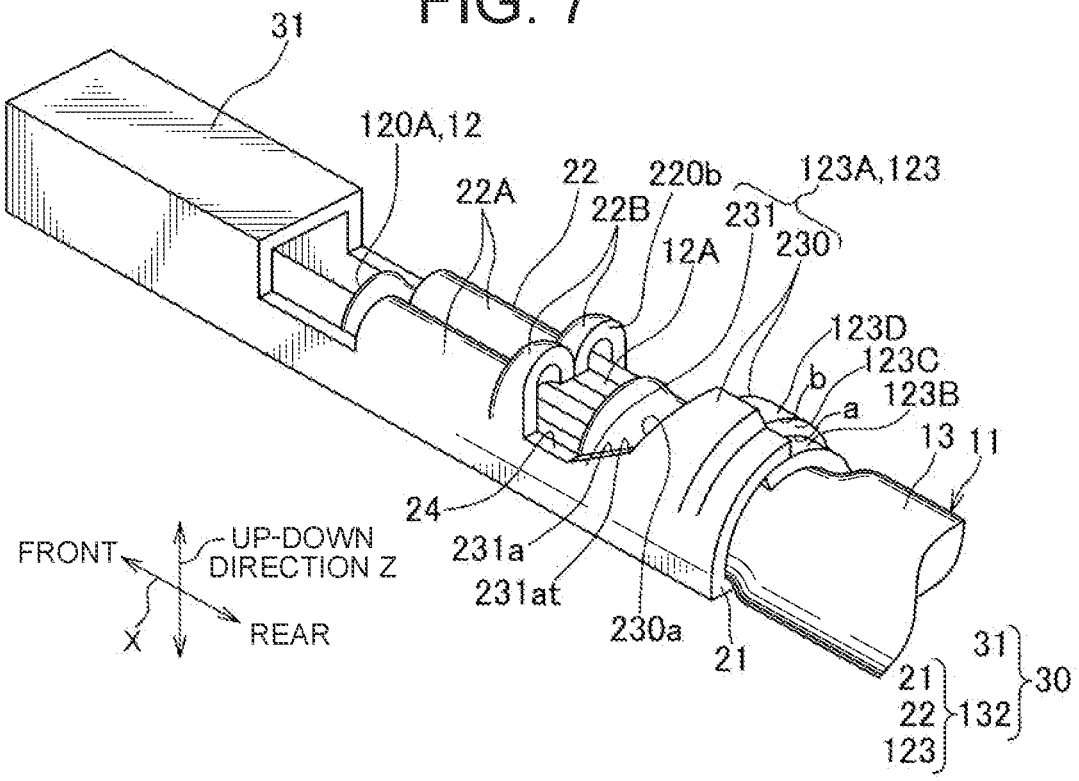
FIG. 7 is a perspective view of the electric wire with terminal and showing a state before application of an anticorrosion material.
Figure 8:
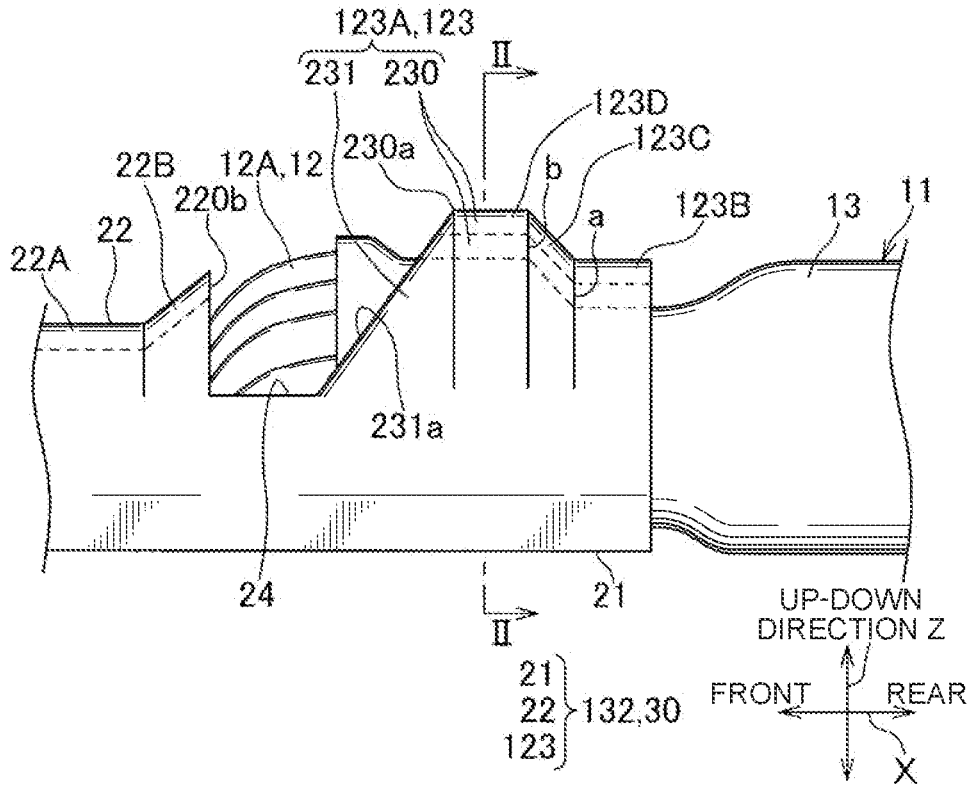
FIG. 8 is a side view of the electric wire with terminal.
Figure 9:
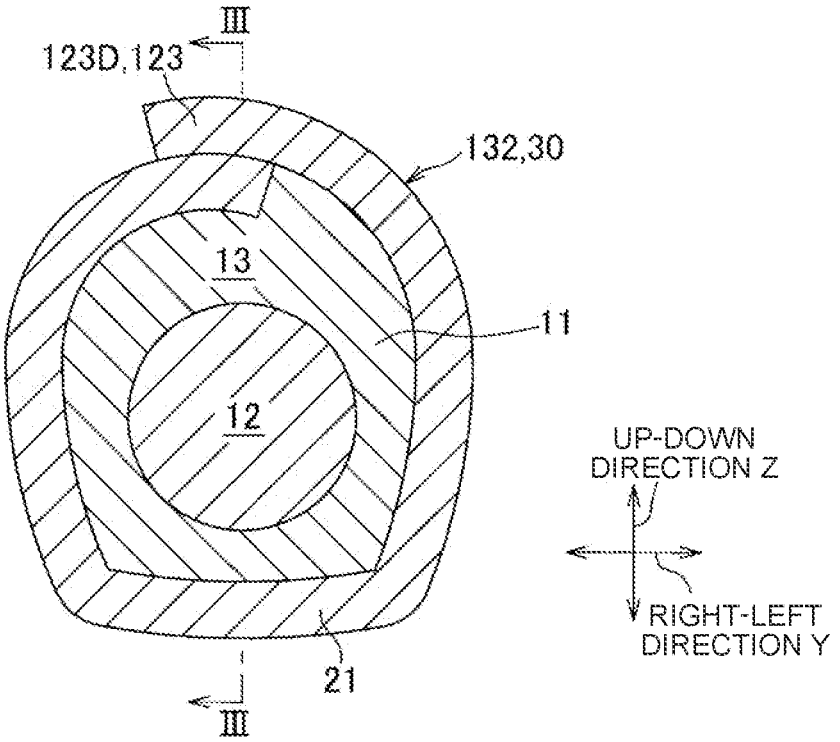
FIG. 9 is a cross-sectional view taken along a line II-II in FIG. 8.
Figure 10:
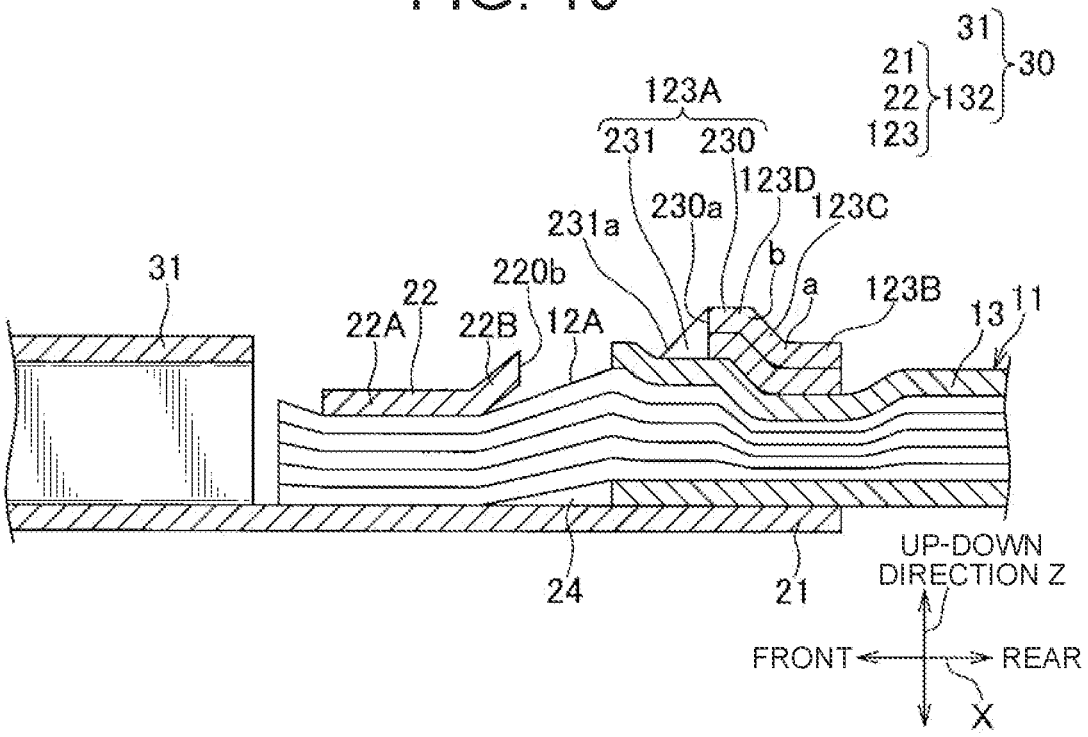
FIG. 10 is a cross-sectional view taken along a line III-III in FIG. 9.
Figure 11A:
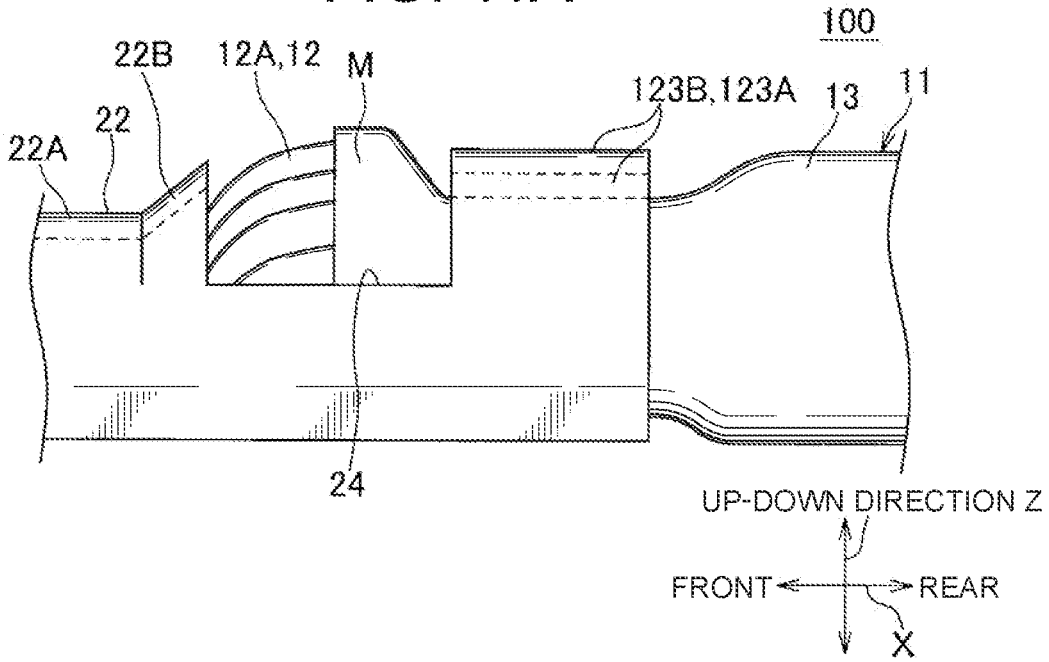
FIG. 11A and FIG. 11B illustrate an action and effect of the electric wire with terminal, FIG. 11A being a side view of a conventional electric wire with terminal, FIG. 11B being a side view of the electric wire with terminal according to the second embodiment.
Figure 11B:
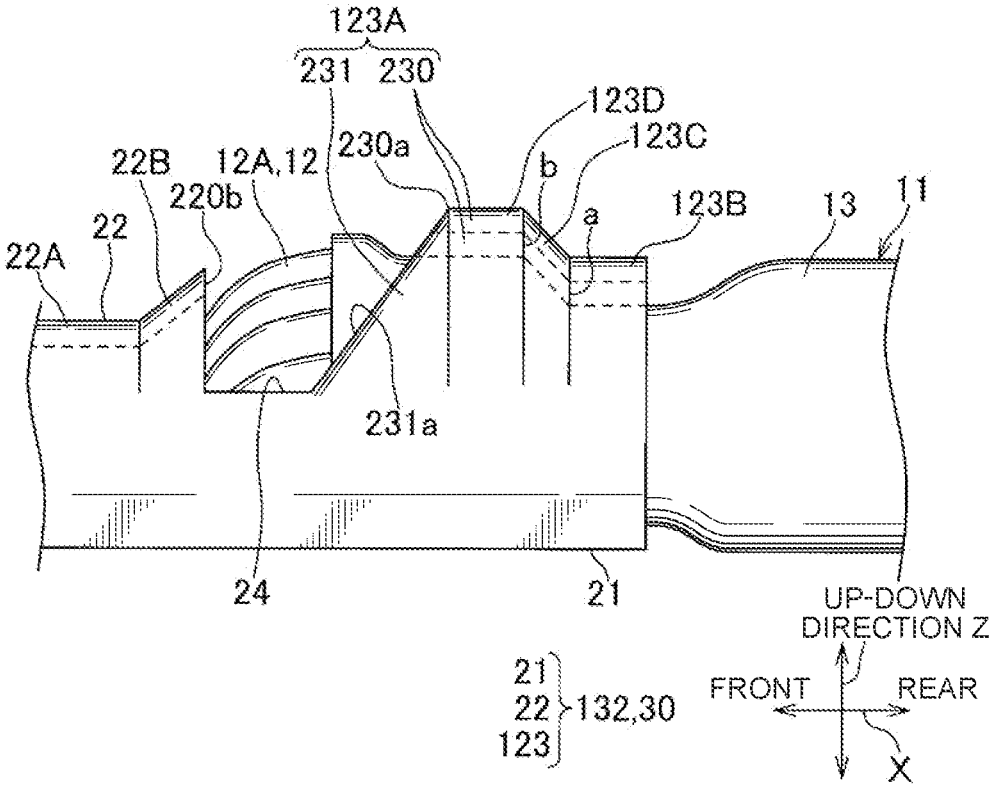

Next, a second embodiment of the present invention will be described with reference to FIG. 5 to FIG. 11. FIG. 5 is a perspective view of an electric wire with terminal 10 according to the second embodiment of the present invention. FIG. 6 is a plan view of the electric wire with terminal 10. FIG. 7 is a perspective view of the electric wire with terminal 10 in a state before the sealing portion 4 is formed. FIG. 8 is a side view of the electric wire with terminal 10. FIG. 9 is a cross-sectional view taken along a line II-II in FIG. 8. FIG. 10 is a cross-sectional view taken along a line III-III in FIG. 9. FIG. 11A and FIG. 11B illustrate an action and effect of the electric wire with terminal 10, FIG. 11A being a side view of a conventional electric wire with terminal 100, FIG. 11B being a side view of the electric wire with terminal 10 according to the second embodiment. The electric wire with terminal 10 according to the second embodiment and the electric wire with terminal 1 according to the first embodiment differ in the configuration of the terminals 3, 30.

As shown in FIG. 5 and FIG. 6, the electric wire with terminal 10 includes the covered electric wire 11 (hereinafter referred to as the electric wire 11), a terminal 30 configured to be connected to each end of the electric wire 11, the sealing portion 4 (anticorrosion portion) covering a portion where the core wire 12 is exposed (hereinafter referred to as the core wire exposed portion 12A) in a state where the pair of core wire crimp pieces 22A, 22A of the terminal 30 is crimped to the core wire 12 of the electric wire 11.

The terminal 30 is constituted of copper or copper alloy. As shown in FIG. 5 to FIG. 7, the terminal 30 includes the mating connection portion 31 configured to be connected to a mating terminal (not shown), and a wire connection portion 132 that is continuous with the mating connection portion 31 and that is configured to be connected to the end of the electric wire 11.

As shown in FIG. 8 and FIG. 9, the wire connection portion 132 includes the placement portion 21 onto which the end of the electric wire 11 is placed, the core wire connection portion 22 (shown in FIG. 8) that is continuous with the placement portion 21 and that is configured to be electrically connected to the core wire 12, and a cover connection portion 123 that is continuous with the placement portion 21 and that is configured to be mechanically connected to the cover 13 of the electric wire 11. As shown in FIG. 8, the cover connection portion 123 is provided at a position spaced a predetermined dimension rearward from the core wire connection portion 22. In the following, this spaced portion between the cover connection portion 23 and the core wire connection portion 22 may be referred to as "intermediate portion 24 (shown in FIG. 8)".

As shown in FIG. 7 and FIG. 8, the core wire connection portion 22 is positioned between the mating connection portion 31 (shown in FIG. 7) and the intermediate portion 24. The core wire connection portion 22 extends from the placement portion 21 and includes the pair of core wire crimp pieces 22A, 22A configured to be crimped to the exposed core wire 12.

As shown in FIG. 7, the pair of core wire crimp pieces 22A, 22A is configured such that the tips of the pair of core wire crimp pieces 22A, 22A are in contact with each other in the state where the pair of core wire crimp pieces 22A, 22A is crimped to the core wire 12. Further, as shown in FIG. 8, the pair of core wire crimp pieces 22A, 22A is bent at a predetermined position in the front-rear direction X such that the rear edges 220*b* thereof extend upward. That is, the core wire inclined portions 22B inclined radially outward are formed on the pair of core wire crimp pieces 22A, 22A in the state where the pair of core wire crimp pieces 22A, 22A is crimped to the core wire 12. The formation of the core wire inclined portions 22B prevents the rear edges 220*b* of the pair of core wire crimp pieces 22A, 22A from biting into the core wire 12 during the crimping.

The cover connection portion 123 extends from the placement portion 21 and includes a pair of cover crimp pieces 123A, 123A configured to be crimped to the cover 13 of the electric wire 11. As shown in FIG. 7 and FIG. 8, each cover crimp piece 123A includes a crimp piece body 230 and a front-side extending portion 231 that is continuous with the front side of the crimp piece body 230. The crimp piece bodies 230 and the front extending portions 231 are extending from the placement portion 21. The crimp piece bodies 230 have a length that the tips thereof overlap each other in a state where the crimp piece bodies 230 are crimped to the cover 13 of the electric wire 11.

As shown in FIG. 6 to FIG. 8, the front-side extending portion 231 includes an oblique edge portion 231*a* that approaches the crimp piece body 230 with distance from the placement portion 21. Ends 231*at* (shown in FIG. 7) of the oblique edge portions 231*a* located distant from the placement portion 21 are positioned closer to the placement portion 21 than the tips of the crimp piece bodies 230, such that the cover 13 of the electric wire 11 is exposed in a trapezoidal shape in a state where the pair of cover crimp pieces 123A, 123A is crimped. Consequently, it possible to visually check a protruding amount of the cover 13 in the front-rear direction X with reference to the front edge 230*a* of the crimp piece body 230, thereby facilitating determination of whether the arrangement of the electric wire 11 and the terminal 30 is appropriate or not.

Further, in a state where the pair of cover crimp pieces 123A, 123A is crimped, the cover connection portion 123 is bent at predetermined two locations "a" and "b", as shown in FIG. 7, FIG. 8 and FIG. 10, thereby forming a recessed portion 123B positioned at the rear end in the front-rear direction X, a cover inclined portion 123C (inclined portion) that is continuous with the front side of the recessed portion 123B and that is inclined radially outward, and an extending portion 123D continuous with the front side of the cover inclined portion 123C. The recessed portion 123B, the cover inclined portion 123C and the extending portion 123D are provided at a position opposite to the placement portion 21. Further, as shown in FIG. 9 and FIG. 10, in a state where the pair of cover crimp pieces 123A, 123A is crimped, the recessed portion 123B, the cover inclined portion 123C and the extending portion 123D are in contact with the cover 13 without a gap.

As shown in FIG. 10, the recessed portion 123B is a portion that is crimped to the cover 13 of the electric wire 11 in a strongest manner as compared with the remaining portions of the cover connection portion 123 in the front-rear direction X. That is, the recessed portion 123B compresses the cover 13 to clamp the cover 13. Thus, an upper face of the recessed portion 123B is positioned at a lowest position (i.e., a position closest to the placement portion 21) as compared with the remaining portions of the cover connection portion 123 in the front-rear direction X, thereby closing a gap between strands of the core wire 12 of the electric wire 11 and a gap between the core wire 12 and the cover 13 to prevent water from entering these gaps.

As shown in FIG. 10, the cover inclined portion 123C is positioned on the front side of the recessed portion 123B and is inclined radially outward to gradually reduce the compression on the cover 13 toward the front side. The formation of the cover inclined portion 123C prevents the pair of cover crimp pieces 123A, 123A from biting into the cover 13 during the crimping.

As shown in FIG. 10, the extending portion 123D is continuous with the front side of the cover inclined portion 123C, and, in this embodiment, the extending portion 123D is configured to include a flat horizontal face in the front-rear direction X and the right-left direction Y. That is, the extending portion 123D is formed to extend to the front side at an angle gentler than the inclination of the cover inclined portion 123C.

Next, an action and effect of this embodiment will be described with reference to FIG. 11A and FIG. 11B. FIG. 11A and FIG. 11B illustrate an action and effect of the electric wire with terminal 10 described above, FIG. 11A being a side view of the conventional electric wire with terminal 100, FIG. 11B being a side view of the electric wire with terminal 10 according to the second embodiment. In the conventional electric wire with terminal 100, in a state where the cover 13 is crimped by the pair of cover crimp pieces 123A, 123A, the cover 13 is clamped with the same strength as the recessed portion 123B over the entire length. As shown in FIG. 11A, in the state where the pair of core wire crimp pieces 22A, 22A is crimped to the core wire 12 and the pair of cover crimp pieces 123A, 123A is crimped to the cover 13, the core wire 12 and the cover 13 are partially escaped to the intermediate portion 24 side due to the clamping by the respective crimp pieces 22A, 123A, and this may generate a raised part (shown with a reference sign M) at the intermediate portion 24 as shown in FIG. 11A. Due to this generation of the raised part M, the crimp pieces 123A may bite into the cover 13 when the cover 13 is crimped and may cause breakage of the cover. In contrast, in this embodiment, as shown in FIG. 11B, the cover connection portion 123 includes the recessed portion 123B, the cover inclined portion 123C (inclined portion) that is continuous with the front side of the recessed portion 123B and that is inclined radially outward, and the extending portion 123D continuous with the front side of the cover inclined portion 123C, thus the clamping force applied on the cover 13 by the cover inclined portion 123C becomes smaller toward the front side of the cover inclined portion 123C, thereby preventing breakage of the cover.

Further, the cover inclined portion 123C (inclined portion) is provided at a position opposite to the placement portion 21. Consequently, even when the raised part M is generated upward as shown in FIG. 11A, the cover inclined portion 123C that is provided at the position opposite to the placement portion 21 can prevent the breakage of the cover without increasing the size in the right-left direction Y.

Further, in the state where the pair of cover crimp pieces 123A, 123A is crimped to the cover 13, the pair of cover crimp pieces 123A, 123A includes the extending portions 123D which are continuous with the front side of the cover inclined portions 123C, and the extending portions 123D are formed to extend to the front side at an angle gentler than the inclination of the cover inclined portions 123C. Consequently, breakage of the cover can be further prevented.

The present invention is not limited to the above-described embodiment and includes other configurations and the like which can achieve the object of the present invention, and modifications and the like as described below are also included in the present invention.

In the above-described embodiment, in the state where the pair of cover crimp pieces 123A, 123A is crimped, the recessed portion 123B, the cover inclined portion 123C and the extending portion 123D are in contact with the cover 13 without a gap; however, the present invention is not limited thereto. If there is a gap formed between the extending portion 123D and the cover 13, then the sealing portion 4 (anticorrosion portion) enters the gap to improve the sealing performance.

Figure 12:
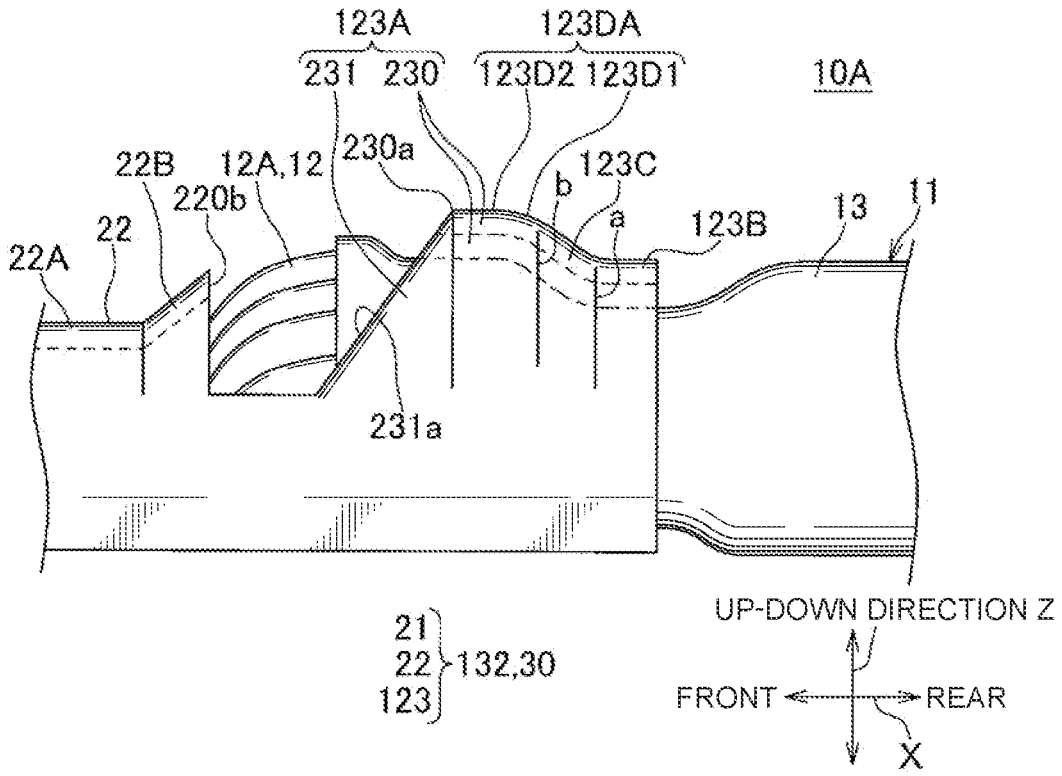
FIG. 12 illustrates a modified example of the electric wire with terminal.

In the above-described embodiment, the extending portion 123D is configured to include the flat horizontal face in the front-rear direction X and the right-left direction Y; however, the present invention is not limited thereto. Like the electric wire with terminal 10A shown in FIG. 12, an extending portion 123DA may include a first extending portion 123D1 continuous with the front side of the cover inclined portion 123C, and a second extending portion 123D2 continuous with the front side of the first extending portion 123D1. The first extending portion 123D1 is continuous with the inclination of the cover inclined portion 123C, and the second extending portion 123D2 may be constituted of a flat horizontal face in the front-rear direction X and the right-left direction Y. In this case, the second extending portion 123D2 is positioned at a highest position (i.e., a position farthest to the placement portion 21) to ensure a certain height. Alternatively, the extending portion 123DA may include a first extending portion 123D1 continuous with the front side of the cover inclined portion 123C, and a second extending portion 123D2 continuous with the front side of the first extending portion 123D1, such that the first extending portion 123D1 and the second extending portion 123D2 are constituted of a smoothly-curved face that is continuous with the inclination of the cover inclined portion 123C.

Figure 13:
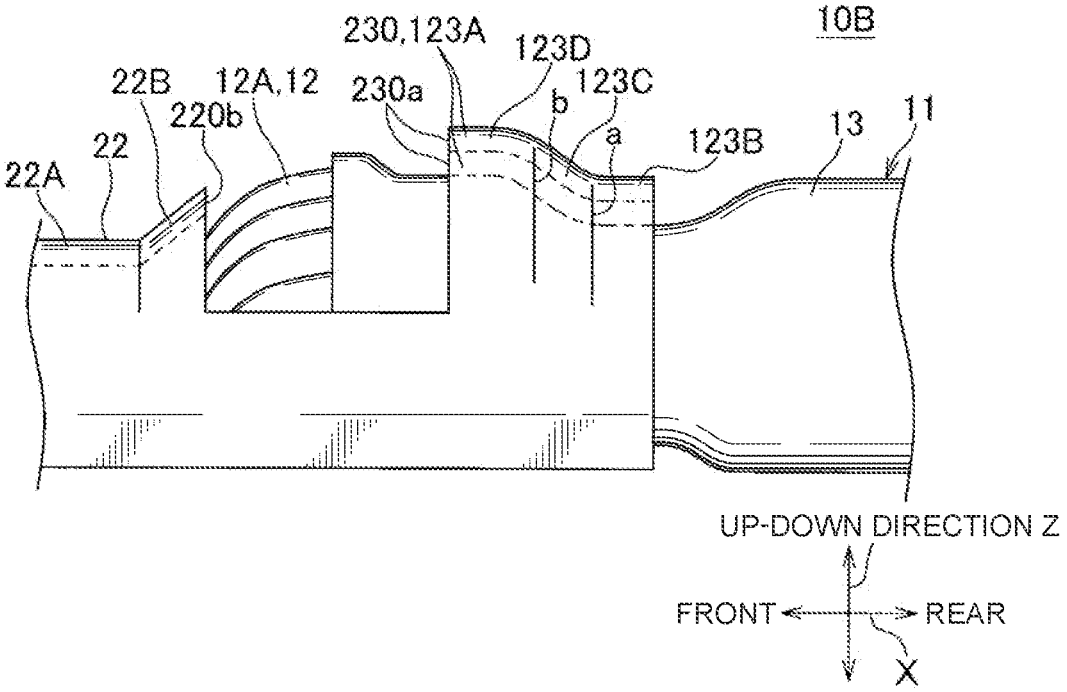
FIG. 13 illustrates another modified example of the electric wire with terminal.
Figure 14:
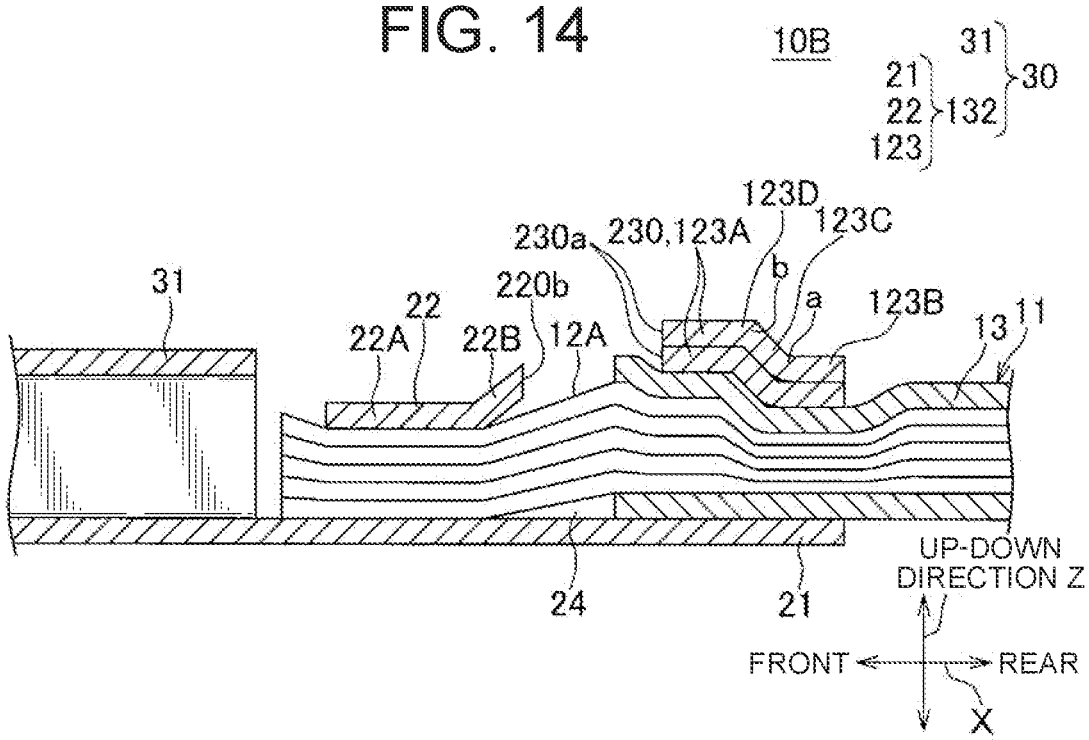
FIG. 14 is a cross-sectional view of the electric wire with terminal.

Further, in the above-described embodiment, each cover crimp piece 123A includes the crimp piece body 230 and the front-side extending portion 231 continuous with the front side of the crimp piece body 230, as shown in FIG. 7 and FIG. 8; however, the present invention is not limited thereto. Like an electric wire with terminal 10B shown in FIG. 13 and FIG. 14, the front-side extending portion 231 may be omitted as long as each cover crimp piece 123A includes the crimp piece body 230.

Figure 15:
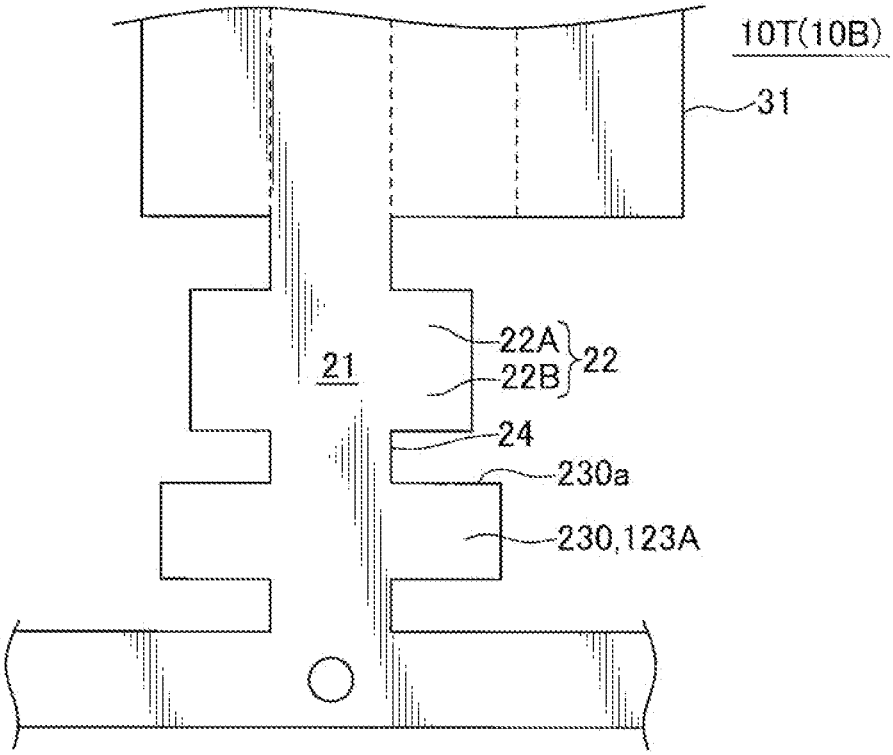
FIG. 15 is an exploded view of a terminal constituting the electric wire with terminal.

FIG. 15 shows an exploded view of the terminal 30 that constitutes the electric wire with terminal 10B. As shown in FIG. 15, the terminal 30 is formed by blanking an electrically conductive plate material to form a portion 10T with a predetermined shape, and bending this portion 10T with the predetermined shape at predetermined positions. Herein, the terminal 30 may be chamfered (deburred) on the front edge 230*a* so that the front edge 230*a* of the crimp piece body 230 is R-chamfered after the portion 10T with the predetermined shape is formed. This can prevent the breakage of the cover 13 of the electric wire 11 during the crimping.

Figure 16:
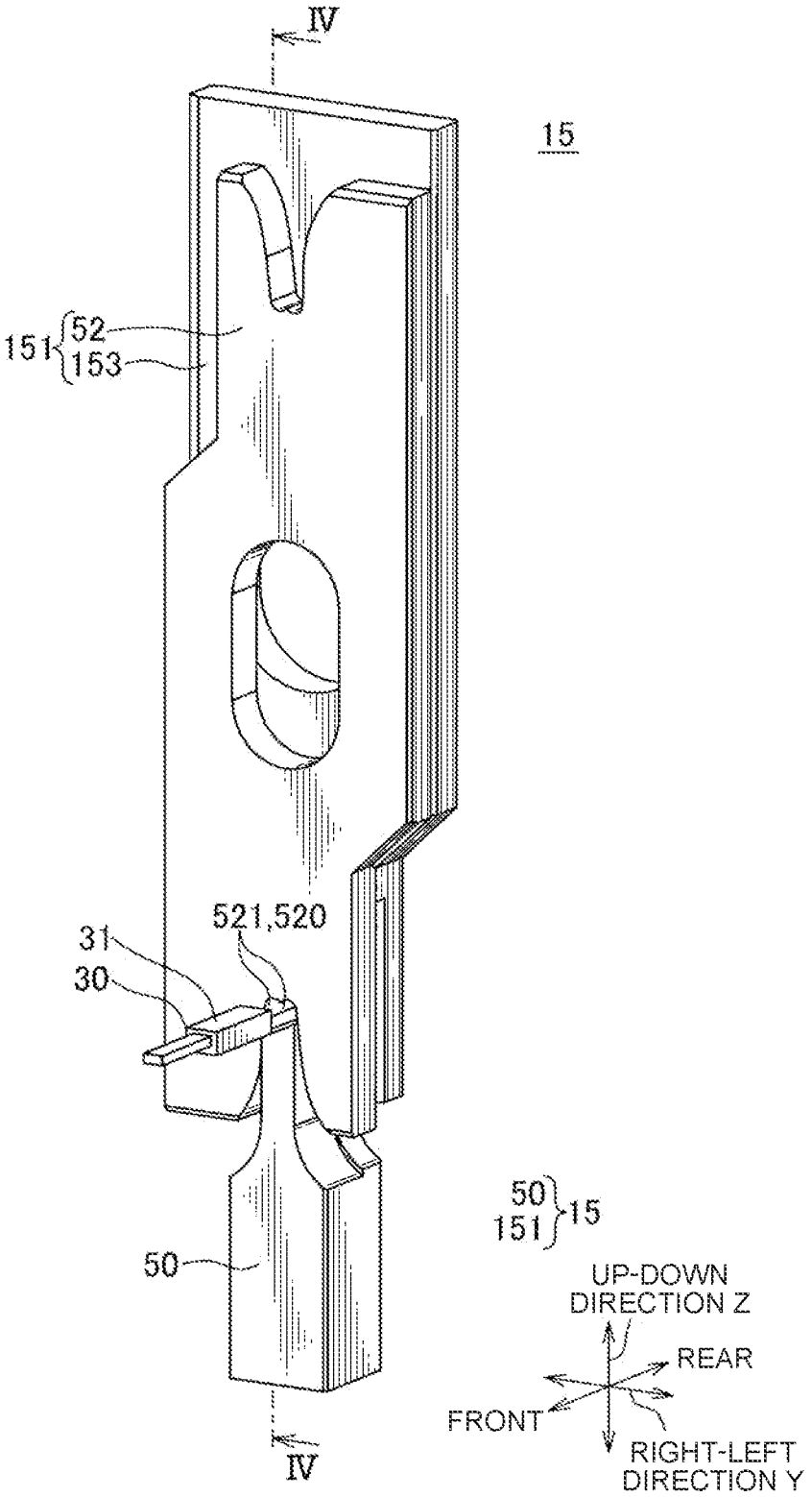
FIG. 16 is a perspective view illustrating production of the electric wire with terminal using a terminal crimping device.
Figure 17:
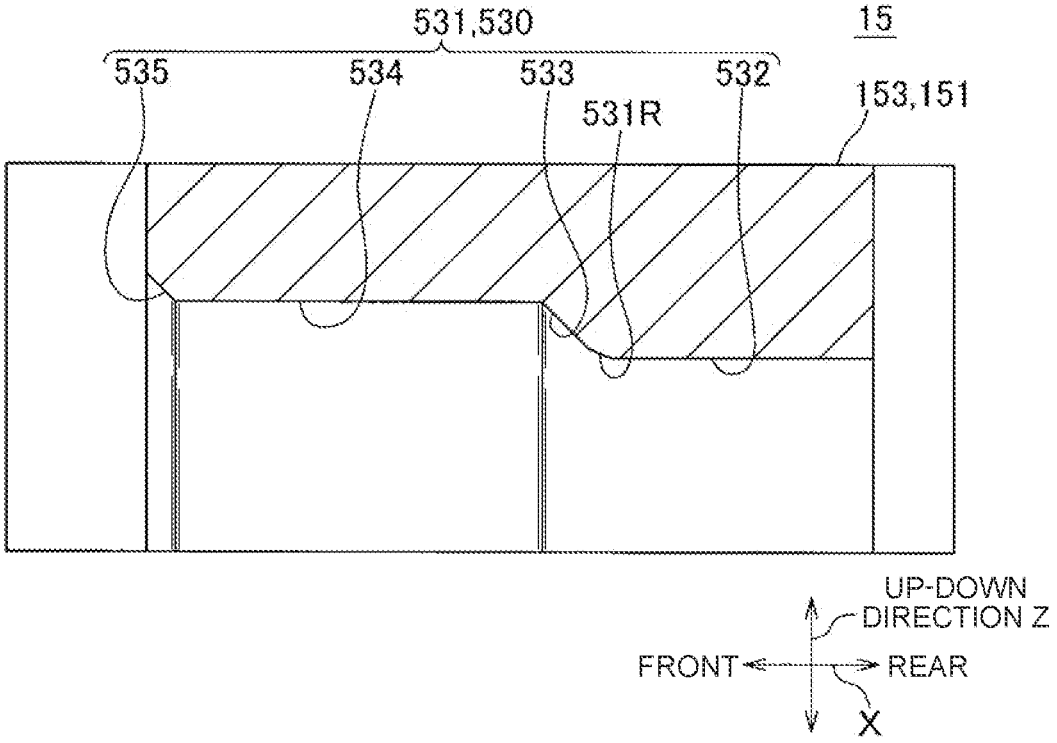
FIG. 17 is a cross-sectional view of a cover crimper constituting the terminal crimping device.
Figure 18:
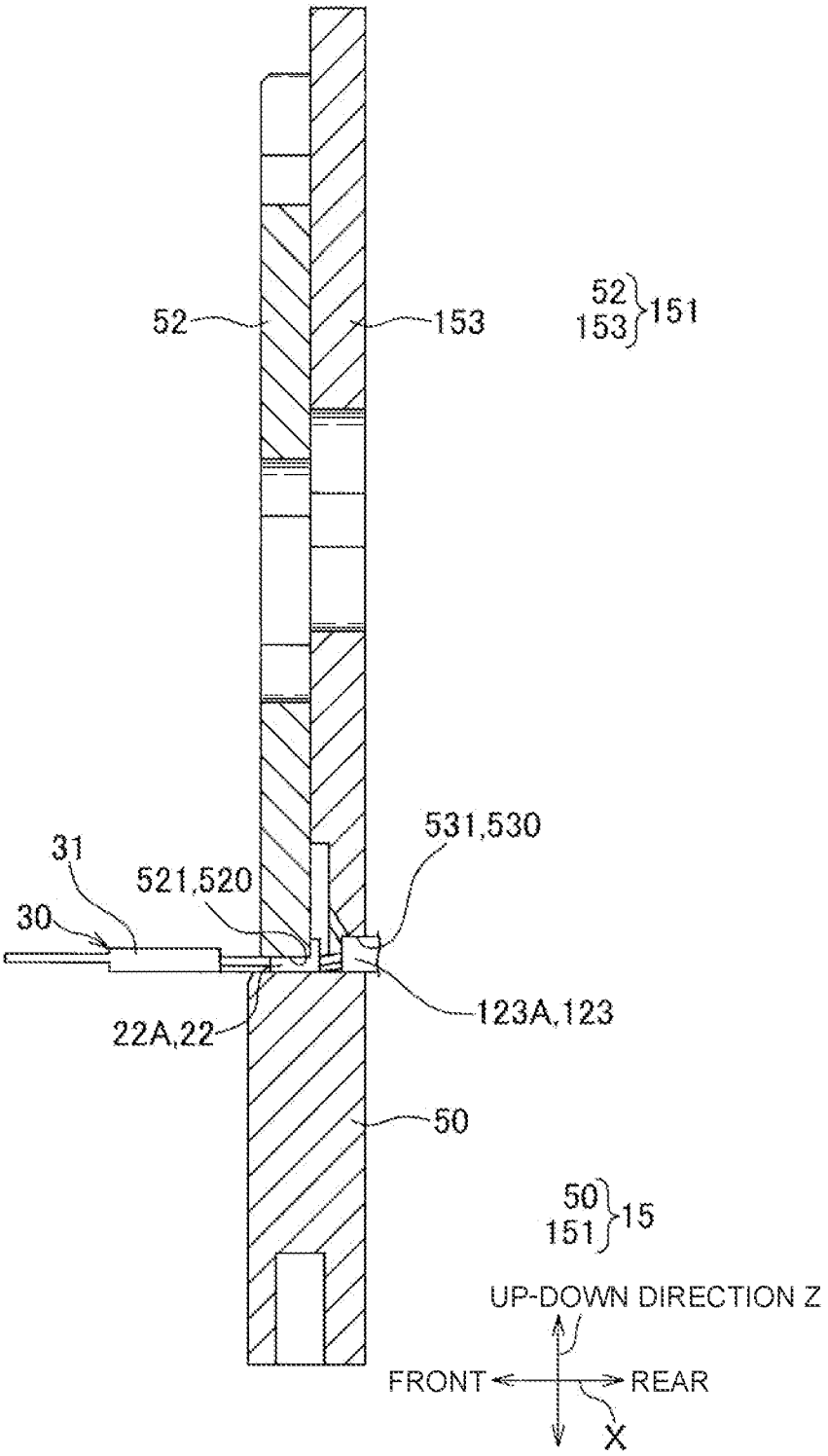
FIG. 18 is a cross-sectional view taken along a line IV-IV in FIG. 16.
Figure 19:
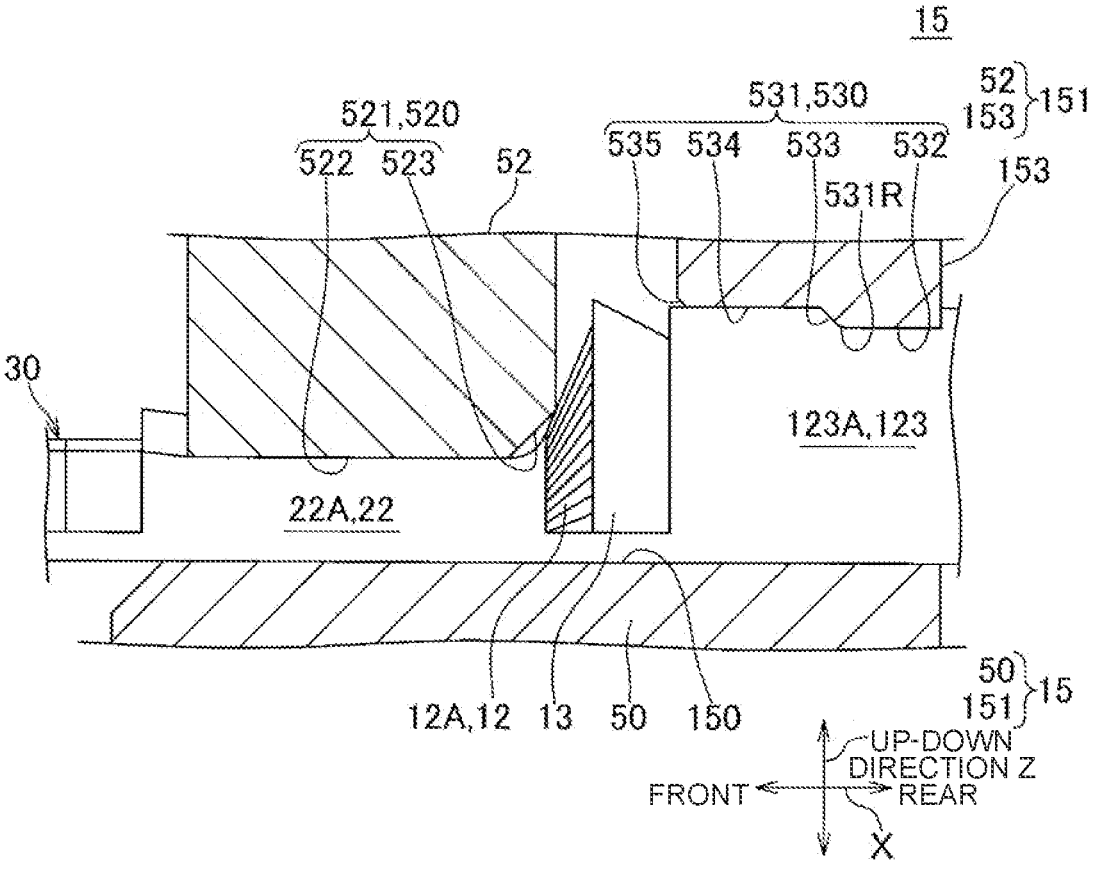
FIG. 19 is an enlarged view of a main part shown in FIG. 18.

Subsequently, the terminal crimping device 15 that is used to connect the terminal 30 to the end of the electric wire 11 will be described with reference to FIG. 16 to FIG. 19. FIG. 16 is a perspective view illustrating production of the electric wire with terminal 10 using the terminal crimping device 15. FIG. 17 is a cross-sectional view of a cover crimper 153 constituting the terminal crimping device 15. FIG. 18 is a cross-sectional view taken along a line IV-IV in FIG. 16. FIG. 19 is an enlarged view of the main part shown in FIG. 18. As shown in FIG. 16, the terminal crimping device 15 includes an anvil 50 and a crimper 151.

As shown in FIG. 19, the anvil 50 includes a support board 150 configured to support the terminal 30 from below. It is configured such that the placement portion 21 of the wire connection portion 132 of the terminal 30 is placed on and supported by the support board 150.

As shown in FIG. 16, the crimper 151 includes the conductor crimper 52 configured to crimp the core wire connection portion 22 of the terminal 30, and the cover crimper 153 configured to crimp the cover connection portion 23. The conductor crimper 52 and the cover crimper 153 are arranged such that the conductor crimper 52 is positioned on the front and the cover crimper 153 is positioned on the rear of the conductor crimper 52, in accordance with the positions of the core wire connection portion 22 and the cover connection portion 123 of the terminal 30 on the support board 150.

As shown in FIG. 16, the conductor crimper 52 is provided with the recessed die for conductor 520 configured to receive the pair of core wire crimp pieces 22A, 22A of the terminal 30 placed on the support board 150. Further, as shown in FIG. 17, the cover crimper 153 (die) is provided with the recessed die for cover 530 configured to receive the pair of cover crimp pieces 123A, 123A of the terminal 30.

As shown in FIG. 18 and FIG. 19, the recessed die for conductor 520 includes the pair of arcuate portions for conductor 521, 521 configured to crimp the pair of core wire crimp pieces 22A, 22A. As shown in FIG. 19, the arcuate portion for conductor 521 includes the arc-shaped curved face body for conductor 522, and a diameter-enlarged face for conductor 523 continuous with the rear side of the curved face body for conductor 522. The curved face body for conductor 522 is formed such that the cross-section thereof in the right-left direction Y has the same shape at any position. The diameter-enlarged face for conductor 523 is constituted of a curved face having a diameter that increases toward the rear side.

As shown in FIG. 18 and FIG. 19, the recessed die for cover 530 includes the pair of arcuate portions for conductor 531, 531 configured to crimp the cover crimp pieces 123A, 123A. As shown in FIG. 19, each arcuate portion for cover 531 includes the arc-shaped curved face body for cover 532 (recess forming portion), the diameter-enlarged face for cover 533 (diameter-enlarged portion) continuous with the front side of the curved face body for cover 532, an arc-shaped second curved face for cover 534 continuous with the front side of the diameter-enlarged face for cover 533, and a second diameter-enlarged face for cover 535 continuous with the front side of the second curved face for cover 534. Each of the curved face body for cover 532 and the second curved face for cover 534 is formed such that a cross-section thereof in the right-left direction Y has the same shape at any position. Each of the diameter-enlarged face for cover 533 and the second diameter-enlarged face for cover 535 is constituted of a curved face having a diameter that increases toward the front side. Further, a boundary position 531R between the curved face body for cover 532 and the diameter-enlarged face for cover 533 is formed to be a smooth curved face.

When connecting the terminal 30 to the end of the electric wire 11, the core wire 12 is exposed in advance by removing the cover 13 at the end of the electric wire 11. Next, as shown in FIG. 16, after the terminal 30 and the end of the electric wire 11 are placed onto the support board 150, the conductor crimper 52 and the cover crimper 153 are together moved downward in the Z direction (the crimping direction) toward the terminal 30 and the end of the electric wire 11. Due to this downward movement, the pair of cover crimp pieces 123A, 123A is received in each recessed die for cover 530 of the cover crimper 153, and the pair of core wire crimp pieces 22A, 22A is received in each recessed die for conductor 520 of the conductor crimper 52, as shown in FIG. 18 and FIG. 19. After the receiving is done, the conductor crimper 52 and the cover crimper 153 continuously apply a constant pressing force in the crimping direction, thereby crimping the pair of core wire crimp pieces 22A, 22A and the pair of cover crimp pieces 123A, 123A, respectively.

At this time, the recessed portion 123B and the cover inclined portion 123C are formed by the curved face body for cover 532 and the diameter-enlarged face for cover 533, and the extending portion 123D is formed and the certain height of the extending portion 123D is ensured by the second curved face for cover 534. Further, the boundary position 531R between the curved face body for cover 532 and the diameter-enlarged face for cover 533 is formed so as to be a smooth curved face, preventing damage to the cover 13. Further, in the case where the front edge 230*a* of the crimp piece body 230 is chamfered so that the front edge 230*a* is R-chamfered as shown in FIG. 15, breakage of the cover 13 of the electric wire 11 can be further prevented during the crimping.

In a manner as described above, the core wire connection portion 22 is electrically connected to the end of the electric wire 11, and the cover connection portion 123 is mechanically connected to the end of the electric wire 11, thereby connecting the terminal 30 to the end of the electric wire 11.

According to the above-described embodiment, the terminal crimping device 15 includes the cover crimper 153 (die) configured to, in the state where the cover 13 is placed on the placement portion 21, put the respective tips of the pair of cover crimp pieces 123A, 123A close to each other and thereby crimp the cover 13, and the cover crimper 153 includes the curved face body for cover 532 (recess forming portion) for forming the recessed portion 123B and the diameter-enlarged face for cover 533 (diameter-enlarged portion) that is continuous with the front side of the curved face body for cover 532. This can attain a configuration in which the recessed portion 123B is formed by the curved face body for cover 532 and the cover inclined portion 123C is formed by the diameter-enlarged face for cover 533 in the state where the pair of cover crimp pieces 123A, 123A is crimped to the cover 13.

A preferred configuration and method and such for implementing the present invention have been described above; however, the present invention is not limited thereto. That is, although the present invention has been specifically shown and described mainly with respect to the specific embodiments, a person skilled in the art can make various modifications to those embodiments described above in terms of shape, material, number and/or other detailed configurations without departing from the scope of technical idea and an object of the present invention. Thus, the descriptions specifying shape, material and such disclosed herein are for the illustrative purpose only in order to enhance understanding of the present invention and are not intended to limit the present invention, thus the descriptions using name of a member without such limitation, either entire limitation or a part of limitation, regarding shape, material, and such, are also within the present invention.

LIST OF REFERENCE SIGNS

1, 10, 10A, 10B electric wire with terminal
3, 30 terminal
4 sealing portion (anticorrosion portion)
5, 15 terminal crimping device
11 electric wire
12 core wire
12A core wire exposed portion (portion where the core wire is exposed)
13 cover
21 placement portion
22A pair of core wire crimp pieces
23A, 123A pair of cover crimp pieces
23B, 123B recessed portion
23C, 23C pair of cover inclined portion (inclined portion)
123C cover inclined portion (inclined portion)
123D, 123DA extending portion
53, 153 cover crimper (die)
532 curved face body for cover (recess forming portion)
533 diameter-enlarged face for cover (diameter-enlarged portion)
L1 dimension in the electric wire extending direction of the recess forming portion
L2 dimension in the electric wire extending direction of the pair of cover crimp pieces before crimping
Y front-rear direction (electric wire extending direction)

What is claimed is:

1. An electric wire with terminal comprising:
an electric wire including a core wire and a cover covering the core wire; and
a terminal to be attached to the electric wire,
wherein the terminal includes
a placement portion onto which the electric wire is placed,
a pair of core wire crimp pieces extending from the placement portion and configured to be crimped to the core wire, and
a pair of cover crimp pieces extending from the placement portion and configured to be crimped to the cover, and
wherein, in a state where the pair of cover crimp pieces is crimped to the cover, the pair of cover crimp pieces includes
a recessed portion positioned at an intermediate position in an electric wire extending direction in which the electric wire extends, and
a pair of inclined portions continuous with both ends of the recessed portion and inclined radially outward,
wherein each inclined portion of the pair of inclined portions is inclined from an end of the cover crimp piece in the electric wire extending direction to the recessed portion.

2. The electric wire with terminal according to claim 1, wherein, in the state where the pair of cover crimp pieces is crimped to the cover, faces of the pair of cover crimp pieces are entirely in contact with the cover.

3. The electric wire with terminal according to claim 1, comprising an anticorrosion portion that covers a portion where the core wire is exposed in the state where the pair of core wire crimp pieces is crimped to the core wire.

4. A terminal crimping device configured to produce the electric wire with terminal according to claim 1, the terminal crimping device comprising:

a die configured to put respective tips of the pair of cover crimp pieces close to each other to crimp the cover in a state where the cover is placed onto the placement portion, wherein the die includes a recess forming portion for forming the recessed portion, and a dimension in the electric wire extending direction of the recess forming portion is smaller than a dimension in the electric wire extending direction of the pair of cover crimp pieces before crimping.

5. The terminal crimping device according to claim 4, wherein, diameter-enlarged portions are provided to positions continuous with the recess forming portion in the electric wire extending direction, the diameter-enlarged portions having a diameter that increases with distance from the electric wire toward the electric wire extending direction, and the diameter-enlarged portions are provided on both sides of the recess forming portion.

6. The terminal crimping device according to claim 4, wherein, a diameter-enlarged portion is provided to a position continuous with the recess forming portion in the electric wire extending direction, the diameter-enlarged portion having a diameter that increases with distance from the electric wire toward the electric wire extending direction, and the diameter-enlarged portion is provided only on a front side of the recess forming portion.

* * * * *